US005996150A

United States Patent [19]

Blevins et al.

[11] Patent Number: 5,996,150

[45] Date of Patent: Dec. 7, 1999

[54] CANTILEVERED MOBILE BED/CHAIR APPARATUS FOR SAFETY PATIENT TRANSFER

[76] Inventors: Jerry L. Blevins, 109 Farm Hill Dr., Toms Brook, Va. 22660; James W. Blevins, 604 Main St., Appalachia, Va. 24216

[21] Appl. No.: 08/835,991

[22] Filed: Apr. 11, 1997

Related U.S. Application Data

[60] Provisional application No. 60/016,254, Apr. 24, 1996.

[51] Int. Cl.[6] ..... A61G 7/08; A61G 7/14

[52] U.S. Cl. ..... 5/613; 5/81.1; 5/611

[58] Field of Search ..... 5/613, 81.1 R, 5/83.1, 86.1, 611, 612, 620

[56] References Cited

U.S. PATENT DOCUMENTS

| | | | |
|---|---|---|---|
| 2,673,987 | 4/1954 | Upshaw et al. | 5/86.1 |
| 2,681,455 | 6/1954 | Schwartz | 5/86.1 |
| 3,111,181 | 11/1963 | Yatich . | |
| 4,119,342 | 10/1978 | Jones . | |
| 4,339,013 | 7/1982 | Weigt . | |
| 4,432,359 | 2/1984 | James | 128/134 |
| 4,679,849 | 7/1987 | Torgny . | |
| 4,717,169 | 1/1988 | Shaffer . | |
| 4,987,620 | 1/1991 | Sharon . | |
| 5,179,745 | 1/1993 | Hebert et al. . | |
| 5,193,633 | 3/1993 | Ezenwa | 5/86.1 |
| 5,230,113 | 7/1993 | Foster et al. | 5/83.1 |
| 5,319,817 | 6/1994 | Hay et al. | 5/620 |
| 5,333,887 | 8/1994 | Luther . | |
| 5,342,114 | 8/1994 | Burke et al. . | |
| 5,402,544 | 4/1995 | Crawford et al. . | |
| 5,477,570 | 12/1995 | Hannant et al. | 5/613 |

OTHER PUBLICATIONS

"Hi-Torque" Acme Power Jack, H&H Engineering of Battle Creek, Michigan, date unknown.

Double Action Cam Brake Pedal. Albion Industries, Inc. , Albion, Michigan, date unknown.

Caster Advertisement, Fairbanks Company, Rome, Georgia, date unknown.

Jump-N-Carry 400, K&K Jump Start/Chargers, Incorporated., Kansas City, Missouri, date unknown.

Universal Timer, Model UT-1, Alarm Controls Corporation, Deer Park, New York, date unknown.

*Primary Examiner*—Michael F. Trettel
*Assistant Examiner*—Fredrick Conley

[57] ABSTRACT

A cantilevered mobile bed/chair apparatus for safely transferring a patient from and to a hospital type bed comprises three hinged together segments forming back, seat and foot platforms operating in conjunction with a four wheeled, rectangular base. The hinged together platforms convert from a fully adjustable chair mode to a bed mode by a first jack located beneath the seat platform. The platforms are raised and lowered by a second jack associated with a telescoping tower attached to an E frame. The telescoping tower is mounted vertically from one side of the rectangular base, and when extended, has a height greater than a hospital bed. The E frame, which supports the platforms, is cantilevered horizontally from the top portion of the telescoping tower, and the height thereof is controlled by the second jack mounted together with the bottom portion of the telescoping tower, to the wheeled base. The side edges of the platforms are beveled or angled downward. When it is desired to transfer a patient from a hospital bed to the bed/chair apparatus, the unit is wheeled over in the bed mode. The tower height is extended by the second jack which enables the platforms to overhang in cantilever fashion the hospital bed by up to eighteen inches, and then lowered so as to press into the mattress of the hospital bed. The angled down edges of the platforms pressing into the mattress results in a tight embrace of the hospital bed, and an almost flat profile for the two beds so that a single caregiver can safely effect the patient transfer. Numerous other features are included for medical and physical maintenance of the patient.

11 Claims, 5 Drawing Sheets

CANTILEVERED MOBILE BED/CHAIR APPARATUS FOR SAFETY PATIENT TRANSFER

This application claims the benefit of U.S. Provisional application No. 60/016,254 filed Apr. 24, 1996.

FIELD OF THE INVENTION

This invention relates to a mobile bed and chair combination for patients in hospitals, nursing homes, or similar health care facilities including the home in which the safe transfer of the patient from a hospital type bed is contemplated by a single healthcare giver.

BACKGROUND OF THE INVENTION

There are various devices known in the art for transporting the disabled from one place to another. The most commonly known is the wheelchair either powered on non-powered. In the hospital and nursing homes, gurneys are used to transfer the patient from one place to another while remaining in a lying or prone position. Often it is necessary to transfer the patient from the hospital bed to a gurney type bed or wheelchair. Studies have shown that upwards to fifty percent of all injuries to either patients or healthcare people have occurred when the patient is being transferred from the bed to a gurney or to a wheelchair. That is, when a patient is transferred from a bed to a wheelchair, the patient must first be raised to a sitting position, rotated so that their feet are over the side of the bed, and then lifted from the bed to the chair. This usually requires three people for a safe transfer, two to lift the patient off the bed, and one to rotate the patient and gently guide him into the chair. Similarly, if the patient is to be transferred from a bed to a gurney, two and sometimes three people are required for a safe transfer; two to lift the patient and one to stabilize the gurney.

Unfortunately, the realities of the healthcare situation in our country and indeed over the world, have stretched the healthcare dollar so thin that many of our provider institutions can no longer provide the necessary personnel to ensure the safe transfer of patients in the above described situations. Instead of the two or three people required to perform the patient transfer, often only one is available. As is often the case, the patient is of a size or weight that is difficult for the healthcare giver to manage by him or herself. The result is either the patient is dropped or the healthcare person sustains a back injury. Such a state of affairs only exacerbates an already strained industry in terms of lost time and money for both the healthcare giver and institution; and the ill will of, or a lawsuit by, the patient should further injury result The prior art has attempted to relieve the situation by providing combination wheelchair and bed mechanisms. For example, the patent to Crawford et al., U.S. Pat. No. 5,402,544, discloses a combination chair and gurney which permits one device to operate both as a wheelchair and as a gurney. The object of Crawford et al. is to attend to the bodily needs of a disabled person. In Crawford et al., the chair can be converted to a bed and then hand cranked to a height to correspond to a bed height. The mobile bed is then placed adjacent the bed and held stabilized by "elastic bungee cords" connected between the rails of the bed and the Crawford et al. device (col. 5 line 25 of Crawford et al.). The problem with Crawford et al. is that there is still a gap between the two beds, and an uncomfortable obstacle in the form of the rails to negotiate in the patient transfer.

Moreover, there is, over time, a very real possibility of the bungee cord breaking with disastrous consequences. Another patent to Ezenwa, U.S. Pat. No. 5,193,633, is designed in particular for paraplegics in a home environment. This patent also shows a chair converting to an adjustable height bed device, and, has a lateral shifting mechanism for use in the wheelchair mode so that ease of reaching over the head by the disabled can be effected. This lateral shifting is stabilized as to the center of gravity by a tilting of the chair toward the center of the wheeled platform. See FIGS. 6 and 7 of Ezenwa. Thus, while this feature is effective for the patient when he reaches high over his head to keep him stabilized, it is counterproductive to the transfer of the patient from the mobile bed to another bed because it presents both a gap between the beds and a raised obstacle therebetween (due to the tilting). This patent like Crawford et al. above is seen to require at least two or maybe three people to effectuate a safe transfer of the patient. Another prior art attempt to address the problem of transporting patients from a bed to a convertible wheelchair/bed structure is disclosed by a patent to Jones, U.S. Pat. No. 4,119,342. In this patent, the wheelchair converts to a bed mode of a fixed height (equal to the height of the wheelchair arms). Thus, it is required that the bed in which the patient is lying be lower than this fixed height, so that the bed mode will then hang over the bed by up to seven inches to perform the transfer. This apparatus suffers from three drawbacks. One, the bed must be lower in height than the Jones device because the device is not adjustable; two, assuming the bed is lower, the obstacle created by the thickness of the platform structure (wheelchair arms and pad) would cause a difficult transfer procedure, if not insurmountable if the bed is even one or two inches below the Jones' bed platform; and three, a seven inch overlap has been found by the inventors hereof to be inadequate to ensure a safe patient transfer by one person. This is because in maneuvering the patient onto beds of different heights, there is usually slippage between the bed structures when one person attempts the transfer. Thus, it is seen that, once again, two and probably three people would be required to safely effect a patient transfer in Jones. Other adjustable height wheelchair to bed structures are disclosed by Burke et al. U.S. Pat. No. 5,342,114, and Hebert et al. U.S. Pat. No. 5,179,745. These patented structures, like Crawford et al. above, are only able to be located next to the bed in which the patient is lying. Moreover, these prior art teachings, unlike Crawford et al., have no bungee cords to help hold the two bed structures together. Thus, a minimum of three people are seen needed to transfer a patient from one bed to the other.

SUMMARY OF THE INVENTION

The present invention is directed to a cantilevered mobile bed/chair that, while in its bed mode, is able to overhang a conventional thirty six inch width hospital type bed by up to half its width in cantilevered fashion so that a safe transfer of a patient can be effected, even by a single caregiver. After the transfer, the patient can then be transported by either remaining in the bed mode, or converted into a chair mode for further patient care. The objects of this invention are carried out by a unique lift structure providing cantilever support for a series of three hinged together platforms making up back, seat and foot portions of the chair/bed. The lift structure comprises a telescoping tower which mounts vertically on one side of a rectangular shaped wheeled base. The platforms comprise the patient support for the bed/chair, and are operatively coupled to an E shaped frame structure that in turn is mounted in cantilever fashion horizontally from the telescoping tower controlled by a screw type jack associated therewith. While a screw jack is provided, it is obvious that other jacks such as hydraulic and scissors may be employed. With this offset tower and cantilever E frame design, the remote side (to the tower) of the platforms of the apparatus in the bed mode are able to overlap a hospital type bed by up to eighteen inches, or half the bed width of a conventional, thirty six inch wide hospital type bed. Thus, when it is desired to transfer a patient from or to a hospital type bed to the apparatus, the jack controlling the telescoping tower operates to raise the platforms above the bed, the apparatus wheeled over to overlap the bed by up to eighteen inches, and then lowered to press into the bed's mattress. Moreover, the platforms comprising the bed are of a thin, highly strong material in which the side edges thereof are beveled or angled downward. This angle down design enables the platforms to further press into the mattress of the hospital type bed, not only ensuring that virtually no movement occurs therebetween, but that a substantially flat profile is presented for the two beds even with a one inch pad on the mobile bed. With such a relatively flat profile, and with the two beds locked in such a tight embrace, it becomes an easy matter for just one caregiver to manage a patient in a transfer procedure.

Although the lift mechanism of the invention can be carried out manually, the best mode comprises an electrically powered lift arrangement. That is, an electric motor is mounted to control a screw jack which is powered by a battery located at the wheeled base of the apparatus. The three platforms forming the head, seat and foot supports are connected by low profile piano hinges. Another electrically driven screw jack is mounted below the seat platform and controls the conversion of the bed into a chair configuration by way of levers and hinges. This second jack, like the first one, is mounted near the tower side of the unit so as to not interfere with the cantilevered overhang portion of the platforms. The chair mode may be under the control of either the caregiver or the patient, and features infinite adjustment for patient comfort. In the case of immobilized patients, there is a auto seat reposition timer feature associated with the chair mode that periodically readjusts the sitting position to minimize bedsores. The seat platform includes a potty hole for increased patient maintenance. The wheeled base, besides providing support for the tower, accommodates; four, omni-directional wheels that may, in some models, be electrically powered; a hazard-free dry-cell, rechargeable battery and holder therefor, and a battery recharging unit. The back platform has provision for an oxygen bottle, while the foot platform includes an adjustable foot rest. The platforms comprising the bed include VELCRO straps for patient safety. The tower also accommodates; an IV holder; combination food tray holder and arm rest that swings into position as needed; and a module for the auto seat reposition timer mentioned above.

Another object of the invention is to provide for a Trendelenburg position bed or where the bed is positioned to have the head lower than the feet. This is accomplished in the bed mode, one of several ways; one, by providing a multi-position gear and locking pin mechanism connected between the tower and E frame, or two, by way of a swing down jack mounted on the E frame. Thus, for example, in the case of the pin and gear arrangement, the pin is pulled and the E frame which is connected to the gear is rotated to be tilted to the desired position, and the pin reinserted to lock the bed in the Trendelenburg position.

A further object of the invention is to allow for portability of the apparatus by keeping the weight to about 160 pounds, yet of sufficient strength to support a load of up to 1500 pounds.

Other objects, features and advantages of the invention will be apparent from the following specification and drawings.

BREIF DESCRIPTION OF THE DRAWINGS

Figure 5:
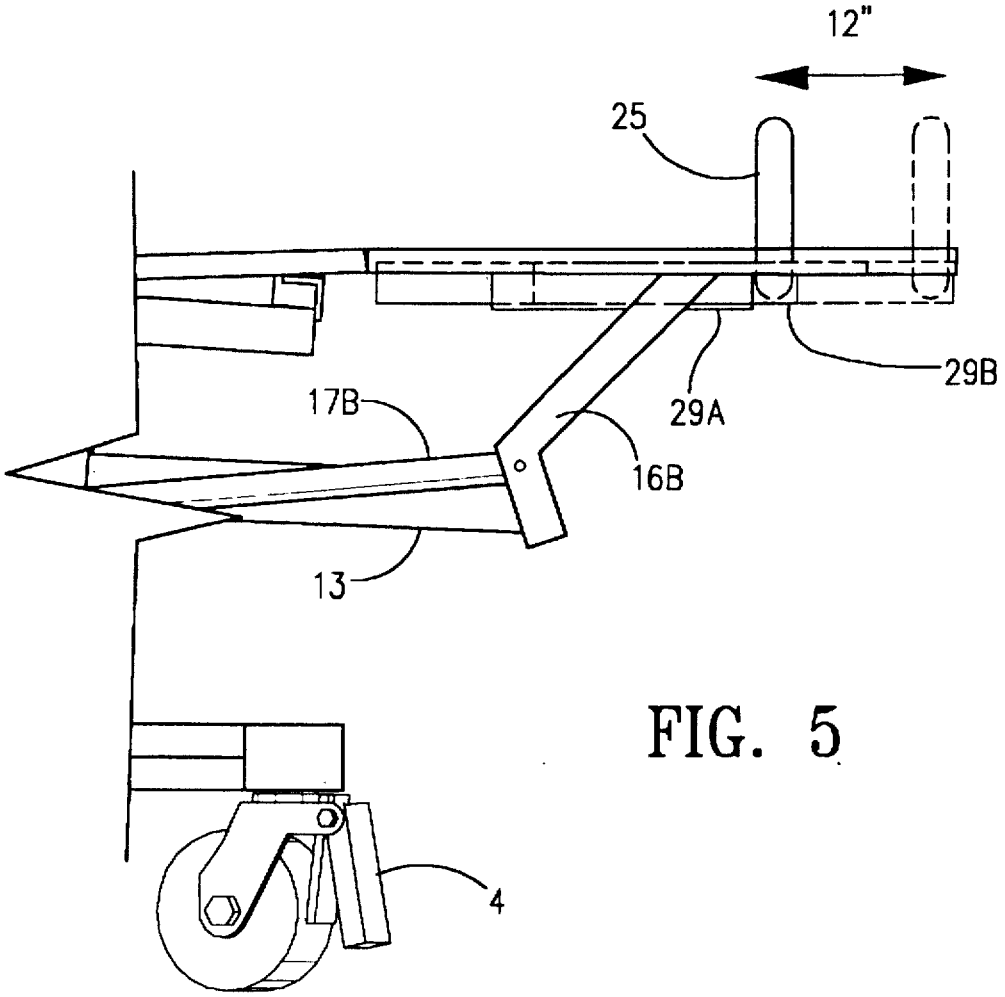
Figure 6:
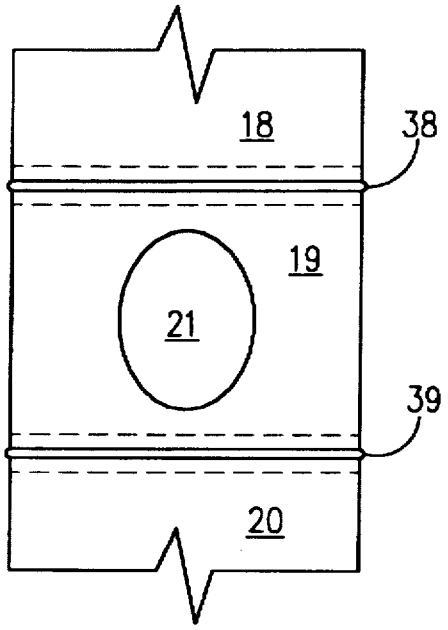
Figure 7A:
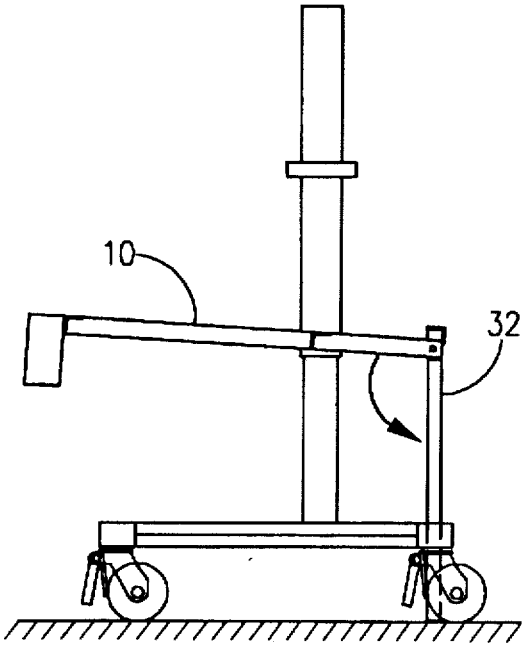
Figure 7B:
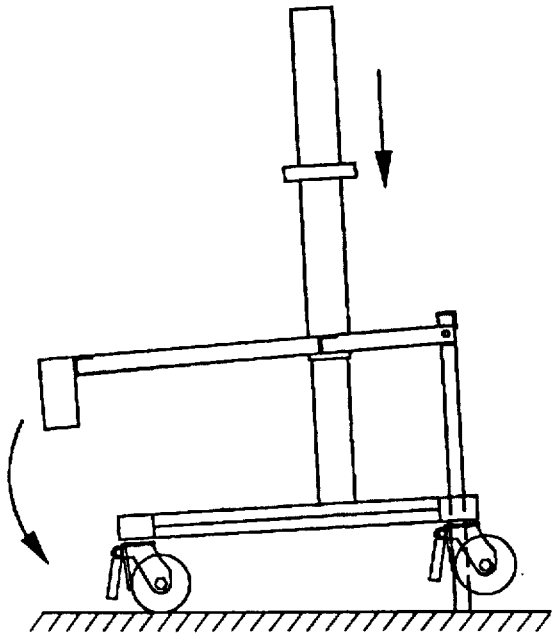
Figure 8:
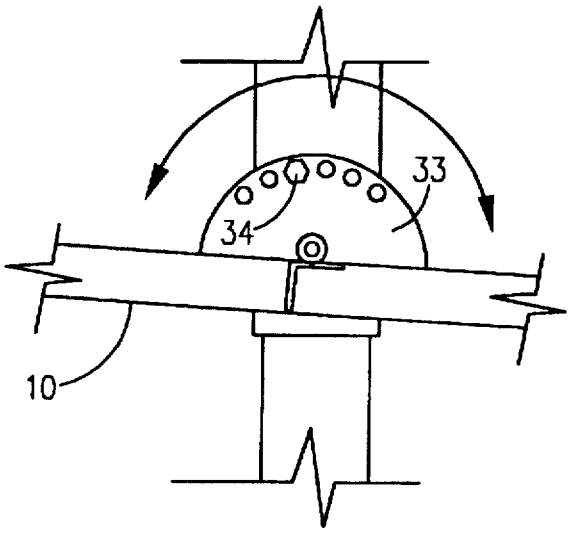

FIGS. 4*a*–4*d* show a step by step procedure for the safe transfer of a patient from the cantilevered bed/chair apparatus to a hospital type bed;

FIG. 5 shows respectively cut-away side view sections of the adjustable foot rest, and wheel and lock mechanism forming a part of the invention;

FIG. 6 is a partial top view of the three hinged together platforms forming the patient support with the middle seat section showing an oval shaped potty hole;

FIGS. 7*a*–7*b* show one method of operating the bed/chair apparatus in the Trendelenburg position; and FIG. 8 shows a second method of operating the bed/chair apparatus in the Trendelenburg position.

DETAILED DESCRIPTION OF THE PREFERRED EMBODIMENT

Figure 1:
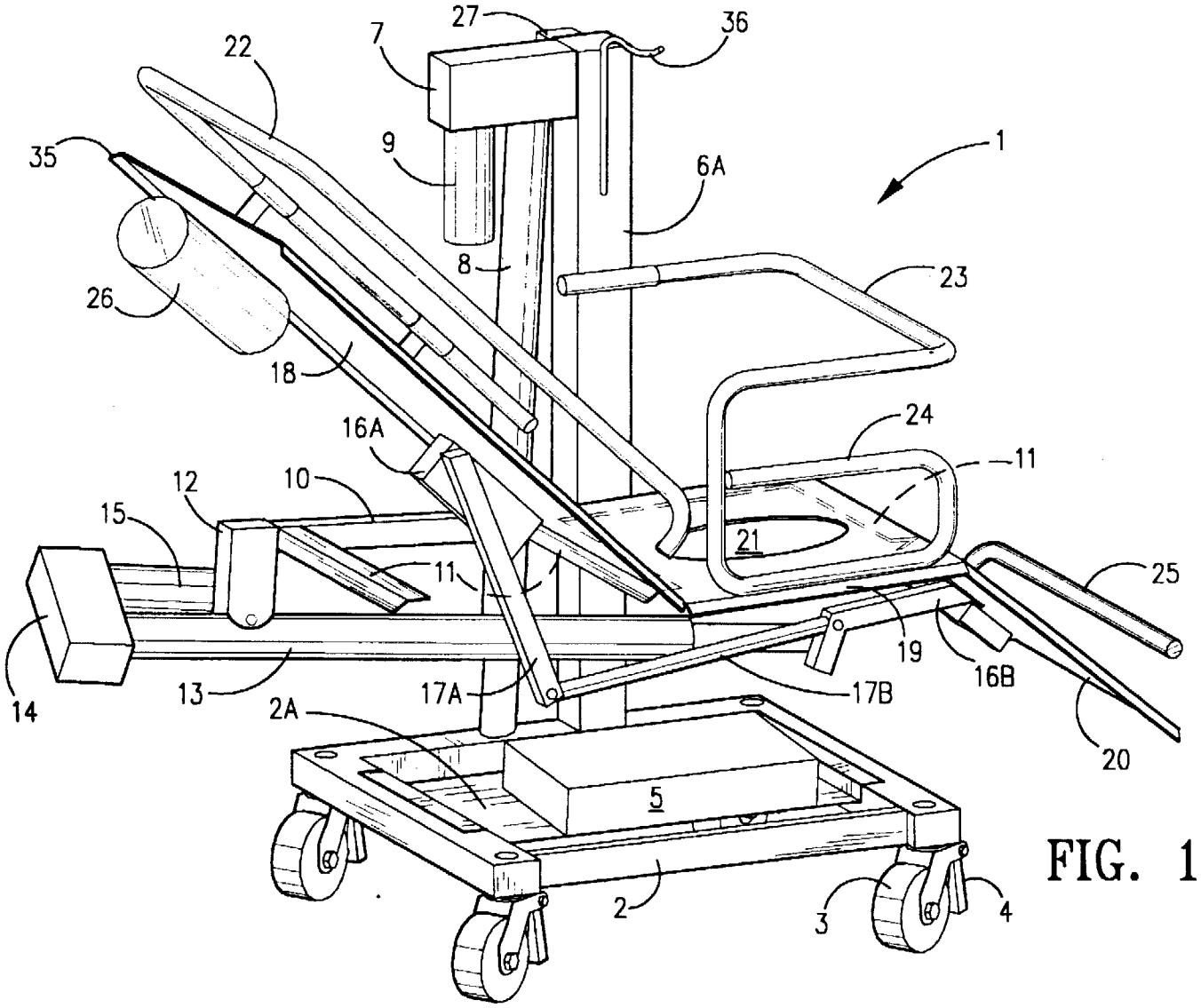
FIG. 1 is a perspective view of the cantilevered mobile bed/chair apparatus in accordance with the invention shown in the chair mode.
Figure 2:
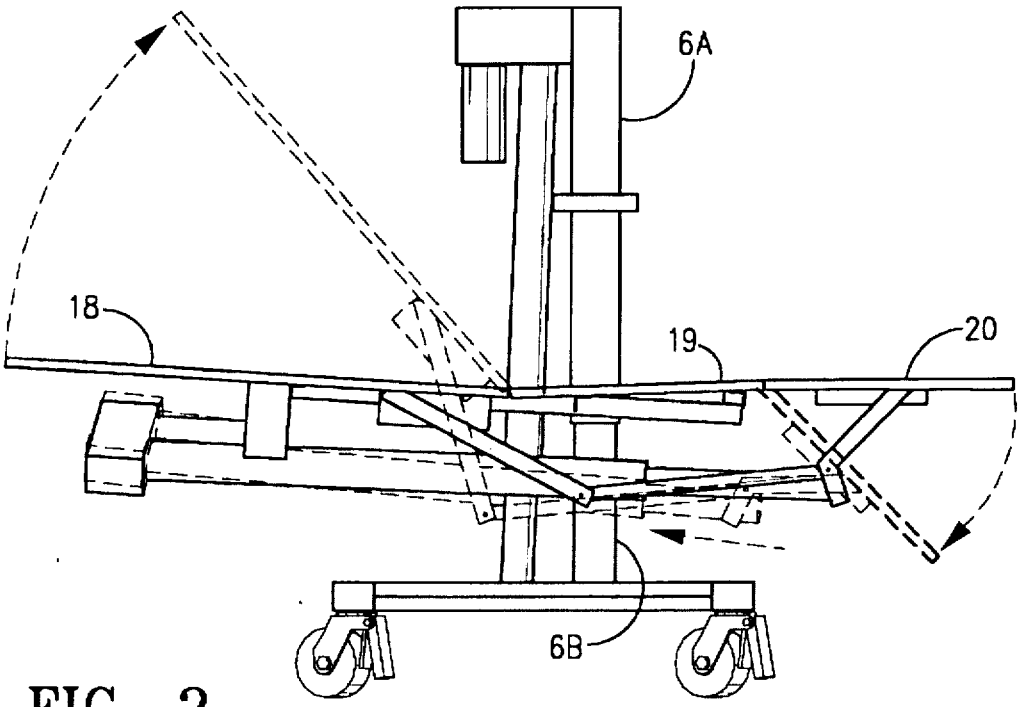
FIG. 2 is a front view of the apparatus showing the bed mode converting to the chair mode in phantom.

Turning to FIG. 1, the overall cantilevered bed/chair apparatus is indicated by 1. A rectangular base 2, made from steel or an equivalent material, provides support for four omni-directional wheels 3, each with a locking mechanism 4. The wheels, seen in greater detail in a cut-away section view in FIG. 5, are five inches in diameter, and are conventional off-the-shelf items such as No. 3W804 Swivel Stretcher Caster with Central Locking System Stem by Wagner. While not shown in the preferred embodiment, the wheels may be motorized in any well known manner, such as shown by the Ezenwa patent referred to above to convert the apparatus to a powered wheelchair. A tray 2A nestles within base 2 to provide support for a 12 volt, dry cell battery and battery charger generally indicated at 5. The battery and charger therefor are conventionally known, such as the "Jump-N-Carry 400" from K & K Jump Start/Chargers, Inc. of Kansas City, Mo. A telescoping tower 6A–6B, made of three and one-half inch square steel for upper section 6A, and three inch square steel for lower section 6B, and, designed to lift 2500 pounds, is mounted on one side of rectangular base 2. Aluminum or other materials may be used instead of steel for the tower without departing from the spirit and scope of the invention herein. The telescoping sections 6A and 6B are raised and lowered by way of a jack 8 supported by a block 7. Jack 8 in the best mode of operation embodiment is a motorized screw jack that is capable of working either by hand or with a motor 9. The motorized jack is a known 12 volt DC motorized jack, such as "Hi-Torque Acme Power Jack" made by H & H Engineering of Battle Creek, Mich.

Attached to the tower in cantilever fashion, at about mid-way, is an E shaped frame having a back 10 and arms 11. Two of the arms 11 are located under, and are attached to a seat platform 19 on either side of a potty hole 21. These arms are made of steel, and are L shaped in cross section for strength. While L shape channel steel is shown, it is apparent that other well known designs for strength, and materials may be employed with equal results. The third arm 11 for the E shaped frame is located approximately midway along a back platform 18, and provides operative support therefor when in the bed mode. The back and seat platforms 18 and 19 are hinged together by a piano hinge, shown in detail in FIG. 6. The seat platform is then connected also by piano hinge to a foot platform 20. The three platforms are made of ⅛ inch aluminum with beveled down edges, and measures twenty four and one-half inches wide by three feet long for back platform 18, eighteen inches long for seat platform 19, and eighteen inches long for foot platform 20, for a total of six feet in length. The beveled edges of the platforms perform a dual purpose, viz.; for providing rigidity for the platforms, and, for effecting an important aspect of the operation of the apparatus, to be described later with respect to FIGS. 4A–4D. While aluminum is disclosed for the material used in the platforms, it is apparent that other materials may be used including steel, plastic or fiberglass without departing from the spirit and scope of the invention. Arms 11 connected to back 10 of an E shaped frame extend approximately two thirds the width of the platforms, and together with platforms 18-19-20, are designed to support a load of 1500 pounds. The three platforms are caused to change position by way of pivoting levers 17A–17B connected to back and foot platforms 18 and 20 by way of anchor blocks 16A and 16B respectively. Anchor blocks 16A–16B are connected approximately four inches from the tower side of the platforms. The location of anchor blocks 16A–16B is important because this will leave approximately 18 inches cantilever overhang for the remainder of the platforms that is free of all obstacles. This can be more clearly seen in FIG. 3. A second jack 13 controls the movement of pivoting levers 17A–17B. Jack 13, like jack 8, is a screw jack that is mounted to back 10 of the E frame with block 12, and is controllable, also like jack 8, either by hand or by a motor 15 supported at 14. It is apparent that other classes of jacks may be employed, such as hydraulic and scissors without departing from the spirit and scope of the invention.

Attached to back platform 18 is a swing away safety guard rail 22 that encircles the patient for safety, while attached to tower 6A is a swing away food tray holder and arm rest combination 23–24 for patient service. An adjustable foot rest 25 attaches to foot platform 20 in a manner described further down with respect to FIG. 5. An oxygen tank holder 26 is conveniently attached longitudinally along the tower side and near the top of back platform 18. An electronic auto seat reposition timer module 27 attaches to the back of tower section 6A, while an IV holder 36 attaches to the front of tower section 6A. Timer module 27 is an off-the-shelf item such as "Universal Timer, Model UT-1" from Alarm Controls Corp., Deer Park, N.Y. This timer controls the periodic repositioning of the bed/chair apparatus when in the chair mode, so that bed sores of an immobilized patient are minimized. Not shown in order to minimize clutter in the figures, are VELCRO safety straps attachable at various points along platforms 18-19-20. For example, the inventors hereof have attached their VELCRO safety straps at the back and foot platforms. It is apparent that such straps may be attached anywhere for optimum patient safety without departing from the spirit and scope of the invention.

OPERATION OF CANTILEVERED MOBEL BED/CHAIR

Figure 3:
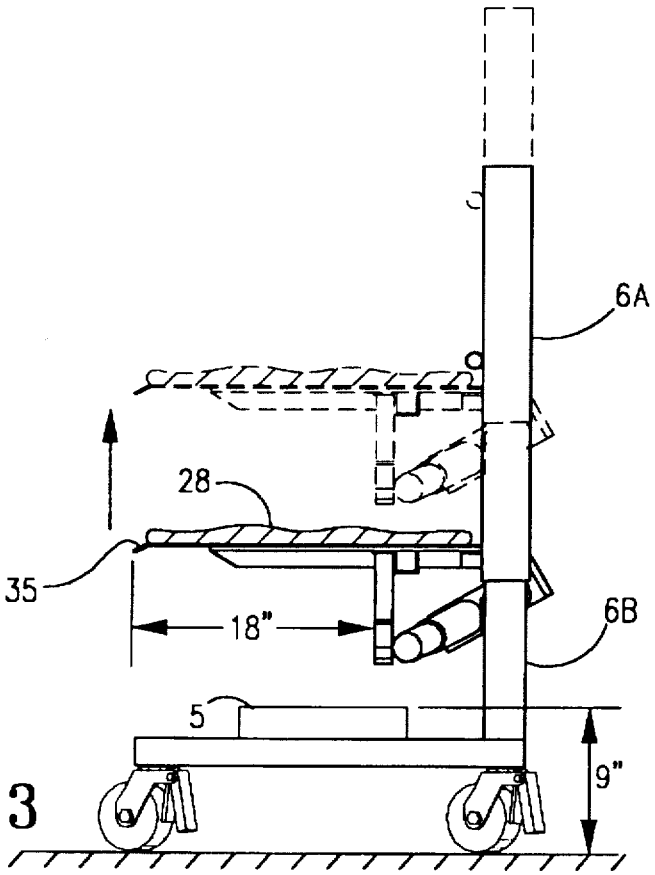
FIG. 3 is a side view of the apparatus showing the cantilevered bed/chair in the bed mode at two different heights.

The operation of the cantilevered bed/chair will be described with reference to FIGS. 2–8. Some of the reference numbers for already identified elements have been omitted in order to keep figure clutter to a minimum. Looking at FIG. 2, the bed/chair apparatus is shown in the bed mode converting to a chair mode seen in phantom lines. It is noted that back platform 18 and foot platform 20 pivot about seat platform 19 which is securely mounted to the E shaped frame. The back and foot platforms move in opposite directions by action of under the seat jack 13 connected to levers 17A–17B (identified in FIG. 1). Thus, as the jack extends, the platforms flatten out to form a bed. A chair is formed when the jack contracts. Jack 13 and connecting levers and blocks are all mounted near tower 6A–6B so as to permit maximum cantilever overhang. This is clearly seen in FIG. 3 which shows an eighteen inch overhang for the cantilevered platforms. Also seen in FIG. 3, is a nine inch height for wheeled base 2 and battery/battery charger 5 combination to enable clearance under a typical hospital type bed with a lowered guard rail. FIG. 3 depicts the cantilevered bed/chair in the bed mode at two different heights. The height is controlled as jack 8 extends to expand telescoping tower 6A–6B. That is, patient platforms 18-19-20, supported by E shaped frame 10–11 attached to section 6A of the telescoping tower, changes height as section 6B of the telescoping tower remains fixed to base 2. The bed has a vinyl covered foam pad 28 of about one inch thickness for patient comfort.

Figure 4A:
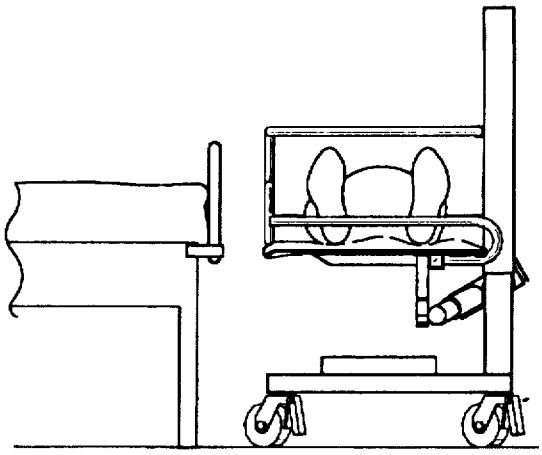
Figure 4B:
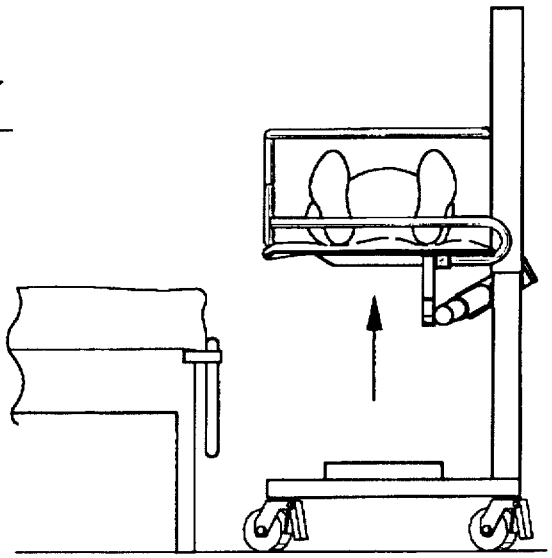
Figure 4C:
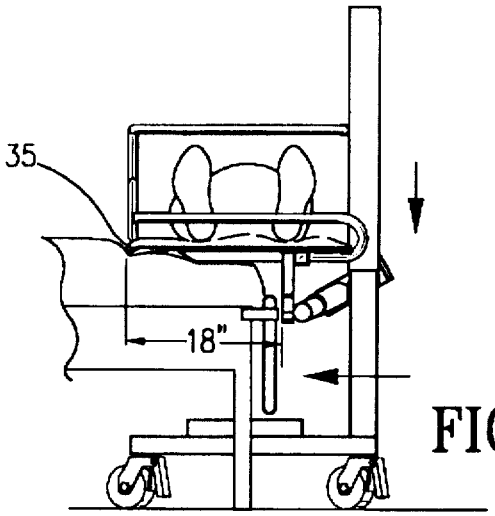
Figure 4D:
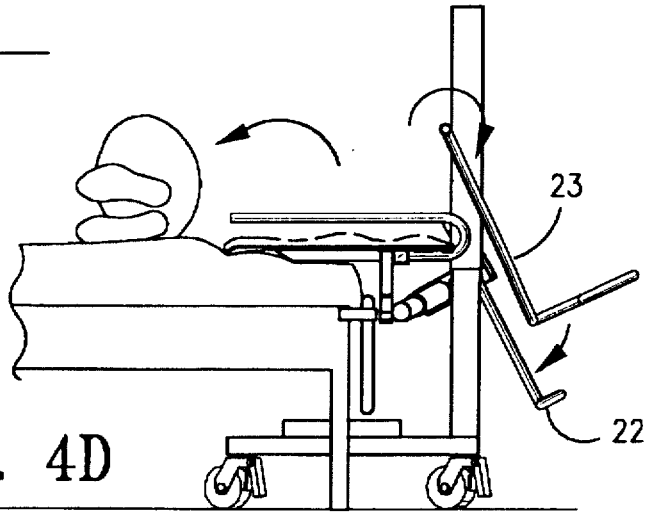

FIGS. 4A–4D show the typical patient transfer procedure for the invention. FIG. 4A shows the patient being transferred in gurney fashion to a hospital type bed with the guard rail up. The height of the cantilevered bed is raised, in FIG. 4B, above the hospital type bed with the guard rail lowered. The cantilevered bed overhangs the hospital type bed by up to eighteen inches as shown in FIG. 4C, and then lowered so as to press into the mattress of the hospital type bed. The pressing in feature of the cantilevered bed is enhanced by the beveled or angled down edges 35 of platforms 18-19-20. It has been found that with the beveled edges pressing into the mattress, together with the relatively thin construction of the platforms (⅛ inch thick aluminum), the side profile of the two beds is almost flat even with a one inch foam pad on the cantilevered bed. Moreover, because the beveled edges "bite" into the hospital type bed's mattress, virtually no movement occurs between the two beds, which greatly facilitates the patient transfer procedure, even by one caregiver. Thus, in FIG. 4D, safety rail 22 and food tray holder/arm rest rail 23/24 are swung back, and the patient is easily rolled over onto the hospital type bed. Should it be necessary to move a patient from a hospital type bed to the cantilevered bed apparatus, the above described procedure would be reversed.

FIG. 5 shows the adjustable foot rest feature of the invention. Since patients come in many different heights, foot rest 25 attaches to a lower bar 29B which slides telescopically in box shaped channel 29A fixed underneath foot platform 20. Thus, if a patient is taller than average, the foot rest is extended and locked in position to provide appropriate foot support. The foot rest is shown with a twelve inch adjustment. This provides accommodation for patients of up to seven feet in height. It is obvious that greater adjustments may be made with foot rests constructed with larger dimensions for bar 29B. As noted above in the description of FIG. 1, wheel 3, also shown in FIG. 5, has a diameter of five inches. This has been found sufficient to accommodate the many different type floor surfaces of most provider institutions.

FIG. 6 shows piano hinges 38 and 39 which, as is well known, have an almost flat profile, yet are extremely strong.

These hinges, as mentioned above interconnect platforms 18, 19 and 20, and are capable of a long, trouble free useful life. Seat platform 19 has an eight inch by twelve inch elliptical potty hole 21, useful for increased patient maintenance.

FIGS. 7 and 8 describe two methods of performing the Trendelenburg position that may be employed in the apparatus herein. This is the position where the head of a patient is made lower than their feet, such as is necessary with some patients suffering from certain heart conditions, or patients in shock. In FIGS. 7A–7B, the Trendelenburg position can be effected with a simple, yet effective swing down bar or jack 32. The bar is normally in a raised horizontal position next to E shaped frame back 10. When it is desired to employ its use, bar 32 is swung down in a vertical position in front of and between the front wheels as shown in FIG. 7A. As the tower is lowered, bar 32 at first makes contact with the floor, and then begins jacking the front half of the apparatus off the floor as shown in FIG. 7B. A second method for effecting the Trendelenburg position is shown in FIG. 8. This method employs a gear and locking pin arrangement in which a gear 33 is fixed to E shaped frame back 10, and to tower 6A by way of a center load bearing or axle. When it is desired to employ the Trendelenburg position, a pin 34 is pulled from a center hole of a series of holes, the platforms tilted to the appropriate position, and the pin reinserted in an off-center hole as shown. Other obvious methods may be employed without departing from the spirit and scope of the inventive apparatus herein. For example, means may be provided for raising the foot platform above the horizontal plane so that the patients legs are raised above their head. Such a means might take the form of a third screw jack connected between a modified lever 17B and the foot platform, to thereby cause only the foot platform to raise when the third jack is extended.

Other features are envisioned for the cantilevered mobile bed/chair apparatus herein. For example, a means for weighing patients while on the apparatus has been successfully tested. Such a means involves a set of two, six inch strain gauge strips glued to the front and back side of tower section 6B near base 2. The strain gauges are connected to a highly sensitive Wheatstone bridge circuit so that any strain on the tower due to a load (such as a patient) on the platforms, translates to a weight on an appropriate scale. Such strain gauges and Wheatstone bridge circuits are known in the art, and may be commercially obtained from e.g., Omega Engineering, Inc. of Stamford, Conn.

The cantilevered mobile bed/chair apparatus disclosed herein weighs only about 160 pounds so as to be portable, and thereby be useful under numerous circumstances and environments. And, despite its many sophisticated features, and its ability to support a load of 1500 pounds, the apparatus herein is designed to be rugged and long lasting.

While this invention has been described in conjunction with a preferred embodiment, it is obvious that modifications and changes may be made by those skilled in the art to which it pertains, without departing from the spirit and scope of this invention, as defined by the claims appended hereto.

We claim:

1. A cantilevered mobile bed/chair apparatus for use with a hospital type bed comprising:

(a) a base having a one side and another side remote from said one side;

(b) a lift means mounted vertically from said one side of said base, said lift means extendible to a height greater than said hospital type bed;

(c) an E shaped frame having a back and three arms shaped in an E configuration, with the back thereof mounted on said lift means and where the arms thereof extend horizontally in cantilever fashion toward said remote other side of said base;

(d) three hinged together platforms forming back, seat and foot supports for a patient, said three hinged together patient support platforms mounted on top of and in operative relation to said three arms of said E frame; and (e) a first jack means having a first end connected to an underside of said back platform and a second end connected to an underside of said foot platform for adjusting said back and foot platforms in opposing relation with respect to said seat platform to thereby convert from a fully adjustable chair mode to a bed mode;

whereby when said lift means is extended, said cantilevered platforms in said bed mode will overhang said hospital type bed by up to eighteen inches.

2. The cantilevered mobile bed/chair apparatus of claim 1 wherein said lift means comprises, a telescoping support means and a second jack means for controlling the height of said telescoping support means.

3. The cantilevered mobile bed/chair apparatus of claim 2 in which said first and second jack means comprises, one of a class of jacks including screw, hydraulic or scissors.

4. The cantilevered mobile bed/chair apparatus of claim 3 in which said class of jack is a screw jack or hydraulic that operates either by a handcrank or by a motor.

5. The cantilevered mobile bed/chair apparatus of claim 1 in which said first jack means further comprises, an auto seat reposition timer means for periodically readjusting said chair mode position, whereby bedsores from an immobilized patient are minimized.

6. The cantilevered mobile bed/chair apparatus of claim 1 in which said hinged together patient support platforms further comprise, a strong, relatively thin material having beveled or angled down side edges, whereby in said bed mode, said platforms will press into a mattress of said hospital type bed when lowered thereon.

7. The cantilevered mobile bed/chair apparatus of claim 1 further comprising, a means for effecting a head of a patient to be lower in attitude than their feet known as the Trendelenburg position.

8. The cantilevered mobile bed/chair apparatus of claim 7 in which said effecting means comprises, a gear and locking pin arrangement interconnecting said E frame and said lift means so that said E frame may by tilted and relocked, to thereby effect said Trendelenburg position.

9. The cantilevered mobile bed/chair apparatus of claim 7 in which said effecting means is a swing down jack attached to one end of said E frame, whereby upon said platforms being lowered, said jack will lift said one end of said apparatus off the ground to thereby tilt said apparatus to effect said Trendelenburg position.

10. The cantilevered mobile bed/chair apparatus of claim 1 further comprising, life and physical support means including IV and oxygen bottle holders respectively attached to said lift means and said back support platform, adjustable foot rest means attached to said foot support platform, swing away safety rail and food tray/arm rest attached respectively to said back support and said lift means.

11. The cantilevered mobile bed/chair apparatus of claim 4 further comprising, battery and battery charger means located on said four wheel rectangular base for supplying electrical energy to all electrical components employed for operating said mobile bed/chair apparatus.

* * * * *